US005727693A

United States Patent [19]

Taylor

[11] Patent Number: 5,727,693

[45] Date of Patent: Mar. 17, 1998

[54] WALL-MOUNTED PAGER HOLDING DEVICE

[76] Inventor: Bennie D. Taylor, 8723 Del Rey Ct., Apt. 8C, Tampa, Fla. 33617-7080

[21] Appl. No.: 644,713

[22] Filed: May 10, 1996

[51] Int. Cl.[6] ..... A47F 7/00

[52] U.S. Cl. ..... 211/13.1; 211/85.9; 211/87.01

[58] Field of Search ..... 211/13, 87, 88, 211/90, 59.1

[56] References Cited

U.S. PATENT DOCUMENTS

| | | | |
|---|---|---|---|
| 776,332 | 11/1904 | Kloeppinger | 211/88 X |
| 1,237,901 | 8/1917 | Hastings | 211/87 |
| 2,894,639 | 7/1959 | Caporicci | 211/90 X |
| 4,008,808 | 2/1977 | Ramsay | 211/88 X |
| 4,336,887 | 6/1982 | Dunne | 211/87 X |
| 4,776,650 | 10/1988 | Ferenzi | 211/13 X |
| 5,097,966 | 3/1992 | Miller | 211/87 |
| 5,337,904 | 8/1994 | Goldberg | 211/13 |
| 5,427,231 | 6/1995 | Willimann | 211/87 X |

*Primary Examiner*—Robert W. Gibson, Jr.

*Attorney, Agent, or Firm*—Dorothy S. Morse; American Inovations, Inc.

[57] ABSTRACT

A pager holding device which has slots for support of multiple pagers and additional features for the support of cellular phones, wallets, keys, loose change, and the like, and which is designed for being mounted on a wall so that young children do not have access to the contents stored therein. Applications may include, but are not limited to, the storage of pagers, cellular phones, wallets, keys, loose change, and other similar objects to which small children are attracted.

5 Claims, 2 Drawing Sheets

WALL-MOUNTED PAGER HOLDING DEVICE

BACKGROUND—FIELD OF INVENTION

This invention relates to holding devices, specifically to a pager holding device which has slots for support of multiple pagers and additional features for the support of cellular phones, wallets, keys, loose change, and the like, and which is designed for being mounted on a wall so that young children do not have access to the contents stored thereon. Applications may include, but are not limited to, the storage of pagers, cellular phones, wallets, keys, and loose change.

BACKGROUND—DESCRIPTION OF PRIOR ART

It is known to have pager holding devices which allow a pager to be worn by a person. The invention in U.S. Pat. No. 5,398,855 to Schaiewitz (1995) discloses a pager holding device which has an elastic loop so that the pager may be worn around a person's neck in a mid-chest position for easy access. Another pager holding device is the invention in U.S. Pat. No. 5,385,282 to Chen (1995) which discloses a casing having a back plate and a clamping plate pivotally mounted to the back plate with spring means therebetween. The clamping plate allows the casing to be attached to the user's clothing. A third pager holding device is disclosed in U.S. Pat. 5,443,193 to Lenard (1995). The Lenard invention is a combination pager holder and coin dispensing device which has a spring clip on its rear wall for detachably mounting its case to the belt of its user. Although all of the above-mentioned pager holders protect pagers from access by young children while the user is wearing them, they do little to protect pagers when a user ceases to wear the holder and places it down on a counter top or a table. Pagers and cellular phones fascinate young children, but in their hands, pagers and cellular phones can easily become damaged or misplaced. Also, the contents of wallets and keys are subject to loss by young children, and loose change is subject to ingestion by young children. Therefore it is desirable to have a location to safely place pagers, cellular phones, loose change, wallet, and keys, so that young children will not damage or lose them. Even when such objects have been left on a high dresser top, young children have been known to find a way to climb to the dresser top to access objects which have caught their attention. It is not known to have a pager holding device which has slots for support of multiple pagers and additional features for the support of cellular phones, wallets, keys, loose change, and the like, and which is designed for being mounted on a wall so that young children do not have access to the contents stored thereon.

SUMMARY OF INVENTION—OBJECTS AND ADVANTAGES

It is the primary object of this invention to provide a wall-mounted holder for pagers which will prevent small children from accessing them. It is also an object of this invention to provide a pager holder which will support more than one pager. A further object of this invention is to provide a pager holder which will also support other objects, to which children are attracted, such as loose change, wallets, cellular phones, and keys. It is also an object of this invention to provide a pager holder which is compactly designed for efficient storage of pagers and other objects.

As described herein, properly manufactured and mounted on a wall, the present invention would provide a convenient, easy-to-use means for storing pagers, loose change, wallets, cellular phones, keys and other objects to which young children are attracted. The present invention comprises a combination of trays, slots, pegs, and shelves for such storage. The preferred embodiment of the present invention is compact in design and made of plastic so that is may be easily cleaned between uses. The present invention has adequate storage space for at least two pagers, two cellular phones, two wallets, and multiple key chains so that more than one person at a time may use it.

The description herein provides preferred embodiments of the present invention but should not be construed as limiting the scope of the pager holding device invention. Variations in the number of slots, the width of the slots, the number of shelves, the overall configuration and dimensions, the number of pegs used, the size of the pegs used, the depth of the shelves, the position of the mounting holes, the number of mounting holes, and the size and number of trays used, other than those shown and described herein, may be incorporated into the present invention. Thus the scope of the present invention should be determined by the appended claims and their legal equivalents, rather than the examples given.

DETAILED DESCRIPTION OF PREFERRED EMBODIMENTS

Figure 1:
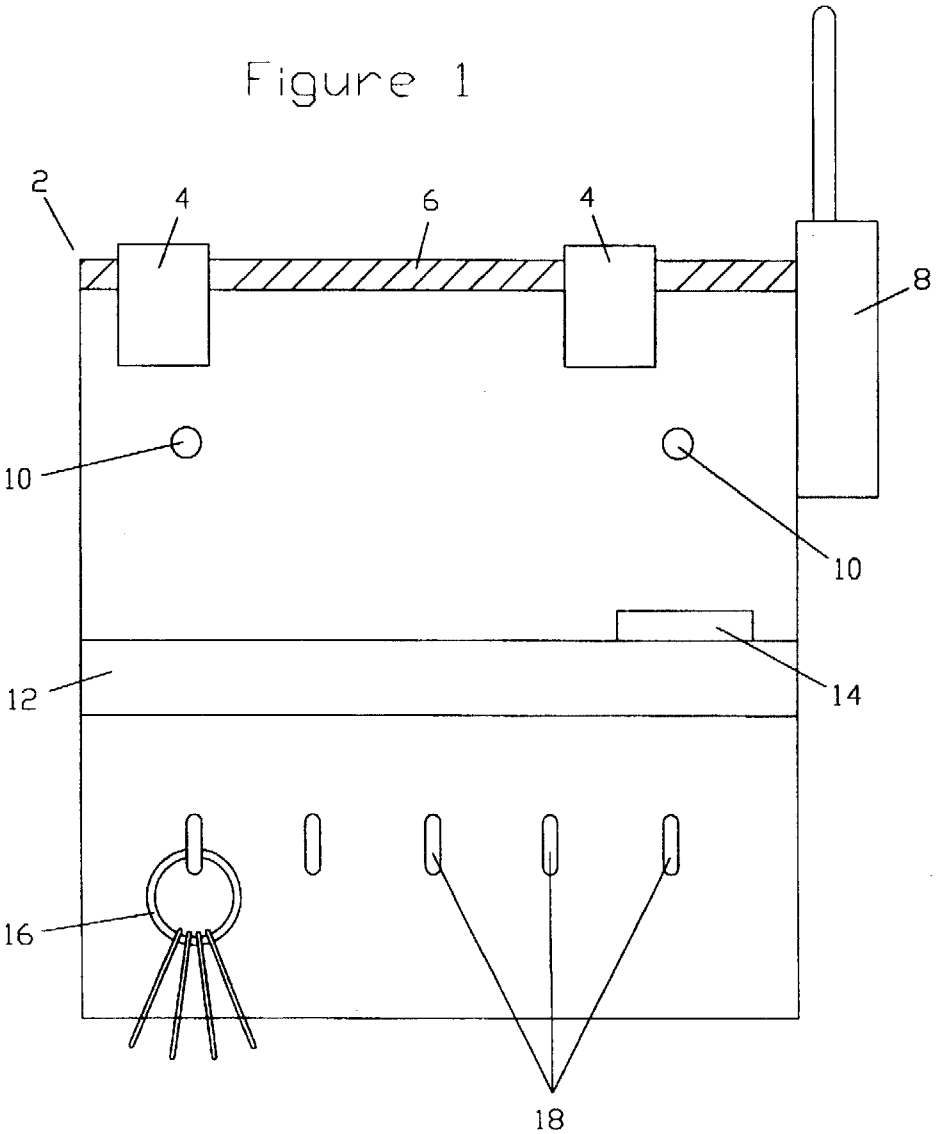
FIG. 1 is a front view of the invention having keys, a wallet, two pagers, and a cellular phone stored thereon.

FIG. 1 shows a preferred embodiment of the present invention having a rear support 2, a top shelf 6 forwardly depending from the upper portion of rear support 2, a lower shelf 12 forwardly depending from the middle portion of rear support 2, a plurality of pegs 18 forwardly and upwardly depending from the front face of rear support 2, and mounting holes 10 positioned through rear support 2 between top shelf 6 and lower shelf 12. In the preferred embodiment it is contemplated for screws (not shown) to be used through mounting holes 10 for attachment of the present invention to a wall (not shown). FIG. 1 also shows a cellular phone 8, two pagers 4, a wallet 14, and keys 16 stored on the present invention. In the preferred embodiment it is contemplated for the present invention to be made of lightweight materials such as plastic. However, the present invention may also be made of others materials, such as wood. Also, the number and placement of pegs 18 and mounting holes 10 is not critical to the present invention and it is contemplated to have more pegs 18 and mounting holes 10, or less than the number shown in FIG. 1. Neither is the placement of lower shelf 12 on the front face of rear support 2, nor the depth of lower shelf 12, critical to the present invention. In addition, it is contemplated for the present invention to have more than one lower shelf 12. Also, although shown in FIG. 1 as a rectangular device, the overall configuration and dimension of the present invention is not critical and it is contemplated to have other configurations.

Figure 2:
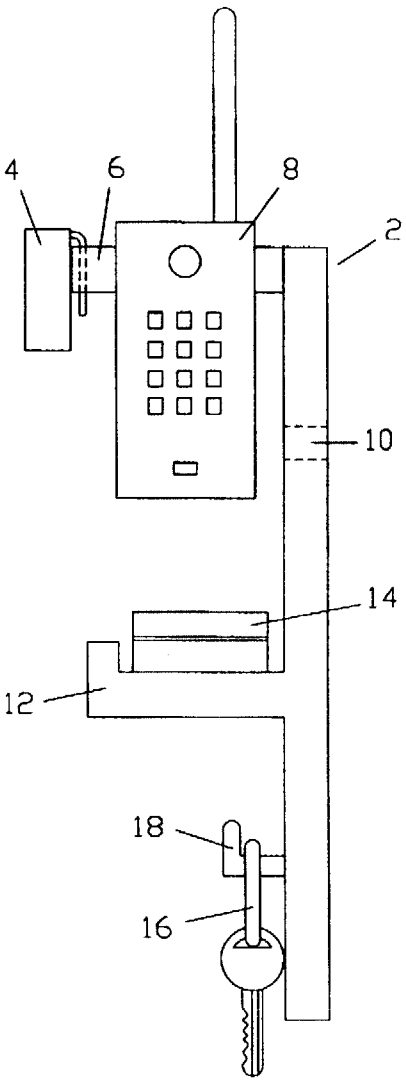
FIG. 2 is a side view of the invention having a key, a wallet, a pager, and a cellular phone stored thereon.

FIG. 2 shows cellular phone 8 and pager 4 attached to top shelf 6. Mounting hole 10 is positioned between top shelf 6 and lower shelf 12. Wallet 14 is stored on lower shelf 12. Also, FIG. 2 shows peg 18 attached to the front surface of the present invention in a position below lower shelf 12, with a key 16 hanging from peg 18.

Figure 3:
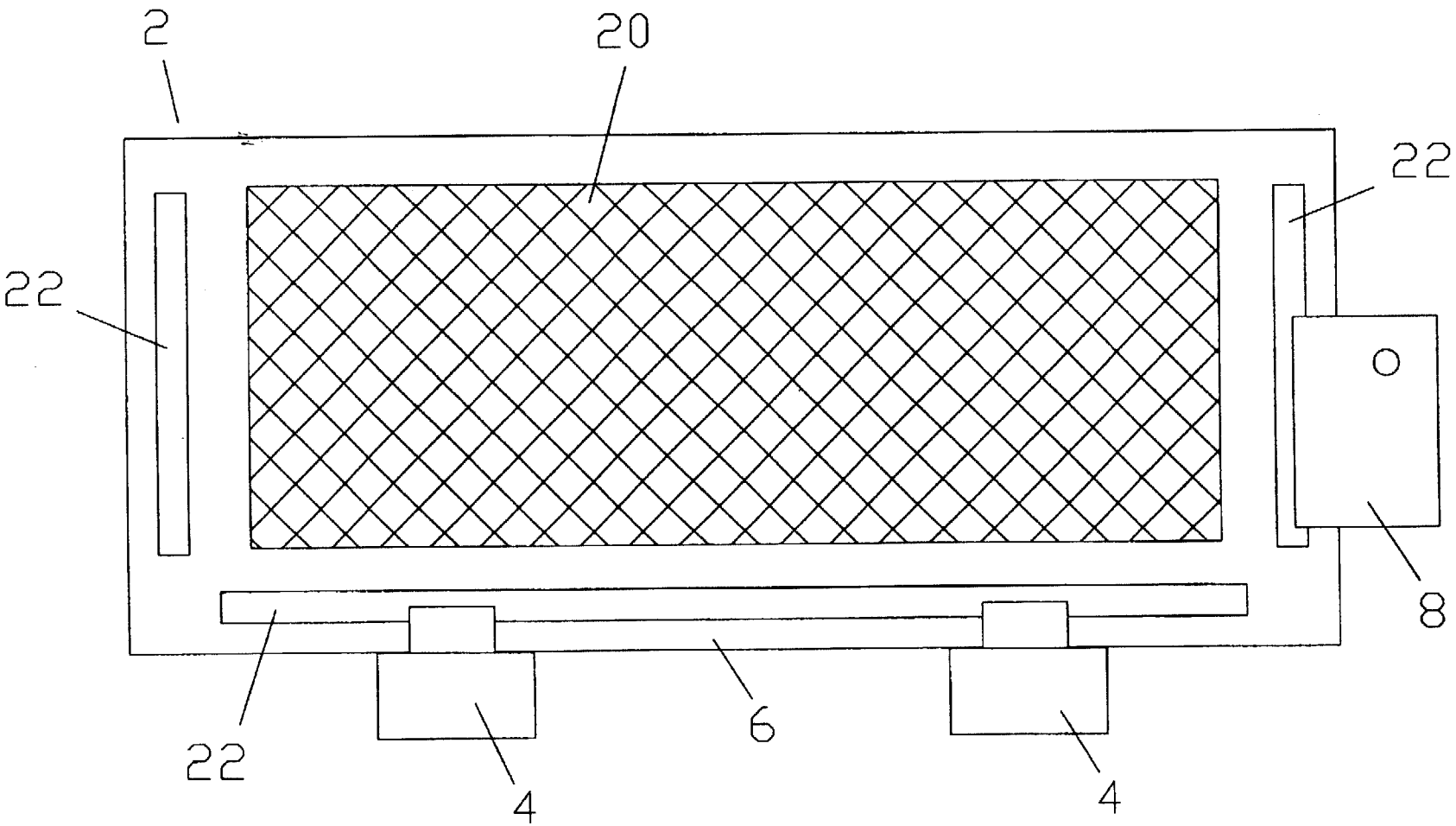
FIG. 3 is a top view of the invention having two pagers, and a cellular phone stored thereon.

FIG. 3 shows top shelf 6 having rectangular configuration and a centrally located tray 20 for the storage of small objects, such as loose change (not shown). FIG. 3 also shows slots 22 through top shelf 6 adjacent to its perimeter along three of its sides. A cellular phone 8 and two pagers 4 are shown in FIG. 3 engaging slots 22 for support. Neither the number, nor the width, of slots 22 are critical to the present invention. Also, the size and configuration of tray 20 is not critical to the present invention.

What is claimed is:

1. A holder for pagers, cellular phones, wallets, loose change, keys, and other objects to which small children are attracted, said holder comprising a rear support, at least one shelf forwardly depending from said rear support, said shelf having a front portion and two side portions, and said shelf defining enclosed slots for the support of said pagers and said cellular phones, said slots being positioned adjacent and parallel to said front and side portions of said shelf, a plurality of pegs forwardly and upwardly depending from said rear support, and mounting means so that said rear support can be mounted against a wall for support of said objects in an elevated position protected from access by said small children.

2. The holder of claim 1 further comprising a tray forwardly, depending from said rear support and having a lip extending from a forward edge of said tray for the support of small objects such as said loose change.

3. The holder of claim 1 wherein said mounting means comprises a plurality of holes through said rear support and a plurality of screws.

4. The holder of claim 1 wherein said holder comprises one-piece molded construction.

5. The holder of claim 1 wherein said holder multi-piece construction.

* * * * *